US006688240B2

(12) United States Patent
Ondrasik

(10) Patent No.: US 6,688,240 B2
(45) Date of Patent: Feb. 10, 2004

(54) SHELVING SYSTEM

(76) Inventor: V. John Ondrasik, 6150 Sheila St., Los Angeles, CA (US) 90040-2407

( * ) Notice: Subject to any disclaimer, the term of this patent is extended or adjusted under 35 U.S.C. 154(b) by 0 days.

(21) Appl. No.: 10/267,131

(22) Filed: Oct. 8, 2002

(65) Prior Publication Data

US 2003/0029362 A1 Feb. 13, 2003

Related U.S. Application Data

(63) Continuation of application No. 09/666,703, filed on Sep. 21, 2000, now Pat. No. 6,526,897.

(51) Int. Cl.[7] ..... A47B 9/00
(52) U.S. Cl. ..... 108/110; 108/147.17; 108/107
(58) Field of Search ..... 108/110, 106, 108/107, 147.11, 147.12, 147.17, 192, 193; 211/90.03, 88.01, 187, 190

(56) References Cited

U.S. PATENT DOCUMENTS 3,007,708 A * 11/1961 Ochs
3,435,958 A * 4/1969 Chesley
3,705,654 A * 12/1972 Barrineau, III
3,915,097 A * 10/1975 Young, Jr.
5,450,971 A * 9/1995 Boron et al.
5,607,068 A * 3/1997 Coretti, Jr. et al.
5,735,221 A * 4/1998 Benayon
5,957,060 A * 9/1999 Rosenband
6,286,694 B1 * 9/2001 Battaglia et al.
6,526,897 B1 * 3/2003 Ondrasik ..... 108/110

FOREIGN PATENT DOCUMENTS

JP 5-192229 * 8/1993
JP 2000-14468 * 1/2000

* cited by examiner

*Primary Examiner*—Jose V. Chen
(74) *Attorney, Agent, or Firm*—Brown, Martin, Haller & McClain LLP

(57) ABSTRACT

A shelving system includes a plurality of shelves each having spaced front and rear hooks projecting from each side edge, each rear hook being spaced forwardly from the rear edge of the shelf, and a support framework for adjustably supporting the shelves at spaced intervals. The framework has a pair of support posts located on each side of the shelves, each pair of support posts comprising a front support post located adjacent the front hooks of the shelves and a rear support post located adjacent the rear hooks of the shelves. Each support post has a series of vertically spaced openings for receiving the shelf hooks. The posts are positioned so they are much less vulnerable to damage, and can be made out of light material with an open configuration. Brackets attach to the shelf to allow the easy addition of useful accessories to the standard shelf.

17 Claims, 7 Drawing Sheets

SHELVING SYSTEM

CROSS REFERENCE TO RELATED APPLICATIONS

This application is a continuation of application Ser. No. 09/666,703 filed Sep. 21, 2000, now U.S. Pat. No. 6,526,897.

BACKGROUND OF THE INVENTION

The present invention relates to shelving systems in which shelves are adjustably supported on vertical support posts.

Shelving systems in which shelves are supported on vertical posts are used commonly in stores for displaying goods to be purchased. One particular application of such shelving is in refrigerated display cabinets, where food and drinks requiring refrigeration are displayed on the shelves within the cabinet. In conventional open-frame shelving systems typically used in refrigerated display cabinets in stores, shelves are supported on a framework comprising four vertical corner posts of square tubular construction, each post having a series of openings for receiving hooks at the corners of the shelves. In such arrangements, each shelf frequently has a cut out at each corner to accommodate the hook and attachment to the post, which reduces display space. Refrigerated display cabinets typically have vertical lighting strips at the junctions between doors which provide access to the shelves. With the conventional shelving arrangement, the front posts are positioned directly behind the lighting strips, obstructing the lighting and casting shadows on the products. Additionally, the rear posts have to be made strong because they are vulnerable to getting damaged by carts or by other means. Also the shelves are not adjustable front to back. Also there is a so-called "end door problem" of trying to fit posts between the last shelves next to a wall and/or another lineup of shelves. Almost always the front and rear posts are the same.

In order to achieve the required strength of the post, but to reduce the amount of material that is needed, the posts are typically made in a tubular shape. This leads to another problem with conventional shelving systems using vertical support posts of tube construction in that the posts cannot be effectively cleaned. This is a particular problem in food stores, where sanitation is a primary concern.

Rear post cantilever type shelving systems are occasionally used as well. This type of system has the advantage of no front post which provides more shelf space and better visibility. However, this system requires a very heavy post and very strong shelves and the shelves are difficult to slant.

SUMMARY OF THE INVENTION

It is an object of the present invention to provide a new and improved shelving system which is particularly suitable for use in grocery stores, convenience stores and the like.

According to the present invention, a shelving system is provided which comprises a plurality of shelves each having a front edge, a rear edge, and opposite sides, each side of a shelf having a front hook projecting from the side and spaced rearwardly a predetermined distance from the front edge of the shelf, and a rear hook projecting from the side and spaced between the front hook and rear edge of the shelf, and a support framework for adjustably supporting a series of shelves at spaced intervals, the framework comprising a pair of vertical support posts located on each side of the shelves, each pair of support posts comprising a front support post located adjacent the front hooks of the shelves and a rear support post located adjacent the rear hooks of the shelves, and each support post having a series of spaced openings for receiving the shelf hooks.

This arrangement provides support posts along the sides of each shelf, rather than at the front and rear corners, and does not require any cut-outs at the corners of the shelf or elsewhere. Thus, lighting strips are not as obstructed, and the entire shelf area can be utilized for holding produce.

In one embodiment, each hook is bent towards the front of the shelf and lies in the same plane as the shelf. The hooks have an undersurface with at least one notch for preventing the hook from being pulled out accidentally. It is easier to install and adjust the slant of the shelf if one set of hooks, usually the front set, is longer. This system frequently allows the slant angle of the shelves to be adjusted even when the shelves are loaded, something that is usually very difficult with the cantilever system. By cutting notches or other locating means in the hooks, the shelves may be adjusted forwards or backwards. The shelves may also be provided with side brackets for attaching accessories such as side product stops and gravity feed racks to a shelf.

There are a number of ways to construct the post component of the system. Among these are:

i) attaching vertical posts to a base that extends to the front and back extent of the shelves. This prevents the system from tipping if the shelves are loaded unevenly. The set of posts may be attached to the frame wall, for example, to keep them in a vertical position.

ii) Another way to secure the post vertically is to fasten two of the base/post sets together at the proper spacing for the shelves into a "box" type configuration. Additional sets of shelves then may be added to the left or right of the "box" with the shelves keeping the base/post set in a vertical position.

iii) The system may also be supported by rigidly attaching the front post to the frame, so that stepping on the rear of the shelf will not lift the post, and placing the front post near the front of the shelf, so that loading the front of the shelf will not lift the rear post. The vertical posts then do not need to be attached to a base.

Each post may be of made with an open profile. One or more side walls of the post may be provided with a series of spaced openings for receiving the shelf hooks or other system components. The open post construction permits easy cleaning and will probably meet sanitation requirements.

The shelving system of this invention provides an easily assembled and stable shelving arrangement for storage or display purposes. The attachment of the shelves to the support posts via side hooks ensures that the entire shelf area is available for display purposes, and also insets the support posts so that the support posts are not vulnerable to carts or the like. This means that the support posts do not have to be as strong, and can be of a more readily cleanable open shape, rather than a closed tube, and can be narrower to provide more unobstructed shelf space and reduce or eliminate the end door problem.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 1:
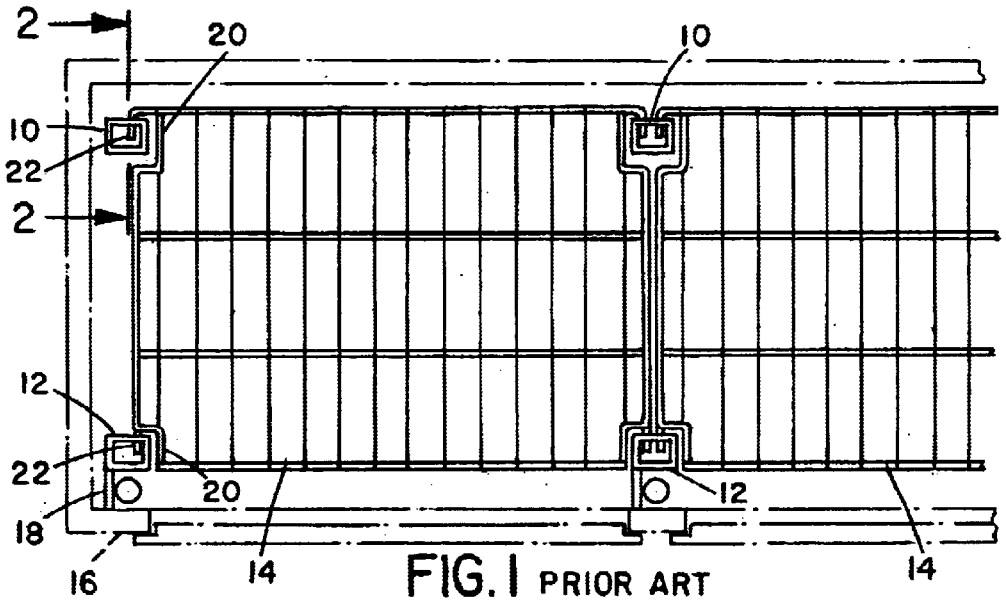
FIG. 1 PRIOR ART
FIG. 1 is a top plan view of a typical prior art shelf assembly.
Figure 2:
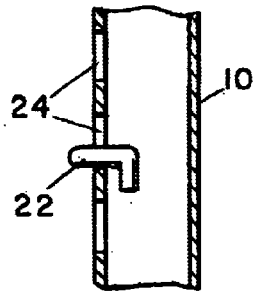
FIG. 2 PRIOR ART
FIG. 2 is an enlarged sectional view taken on line 2—2 of FIG. 1.
Figure 3:
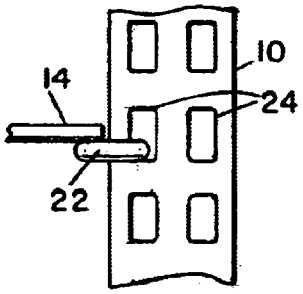
FIG. 3 PRIOR ART
FIG. 3 is a rear view of a portion of a post of FIG. 1.

FIGS. 1 to 3 of the drawings illustrate a typical prior art shelving system as used in a refrigerated display cabinet of a grocery store or convenience store. The basic shelving unit in this system comprises a pair of upright rear corner posts 10, a pair of front corner posts 12, and a series of shelves 14 releasably supported in the front and rear corner posts at their corners. The front corner posts are each secured to the door frame 16 of the refrigerated cabinet by brackets 18. The rear posts are free standing. Each shelf has a cut-out 20 at each corner with hooks 22 projecting into the cut-out for engagement through a selected opening 24 in a support post.

Figure 1A:
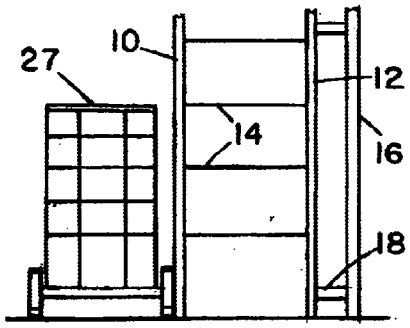
FIG. 1A PRIOR ART
FIG. 1A is a side elevational view of the shelf assembly of FIG. 1 with a cart running along an aisle behind the assembly.

The prior art shelving system has a number of disadvantages. First, the support posts are of square tubular construction. This makes them very difficult to clean inside, so that it is difficult or impossible to meet sanitation standards for using such systems in connection with consumable items. Secondly, the cut-outs at the corners of the shelves reduce the space available for product storage and display. Another problem is the positioning of the front corner posts directly behind the lighting strips 26 for the cabinet, such that they block the light and cast shadows over the items displayed on the shelves. Also, the rear corner posts are at the back of the shelf, making them vulnerable to getting hit by carts 27 and the like as shown in FIG. 1A.

Figure 4:
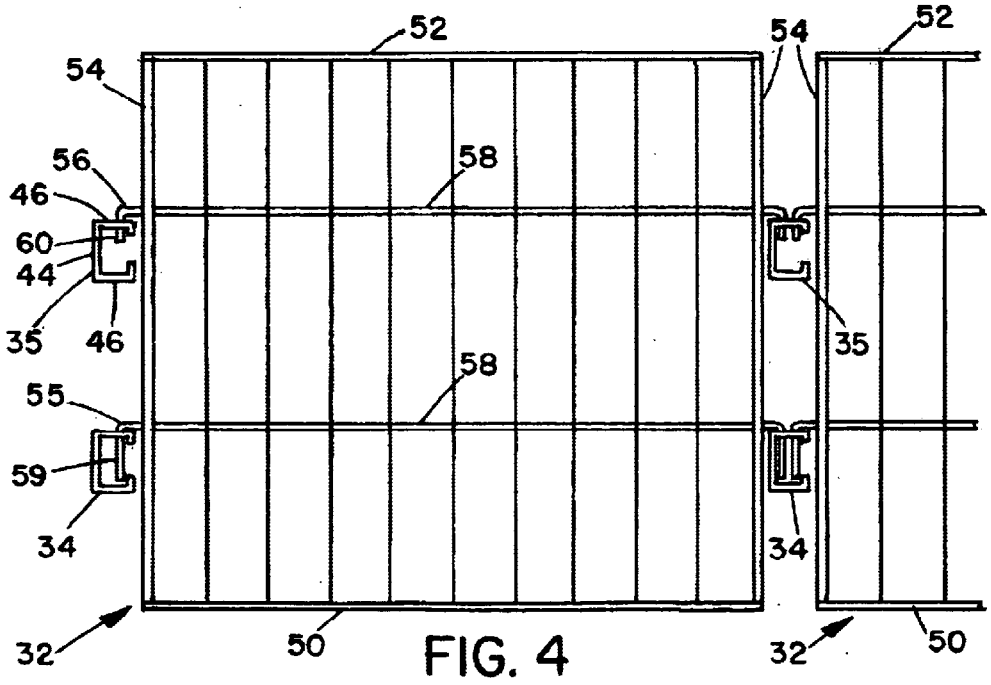
FIG. 4 is a top plan view of an exemplary shelf assembly of the present invention.
Figure 11:
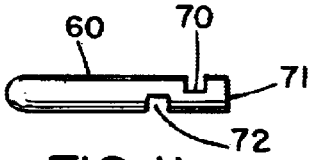
FIG. 11 is a side view of a rear mounting hook.
Figure 12:
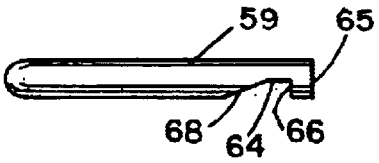
FIG. 12 is a side view of a front mounting hook.
Figure 13:
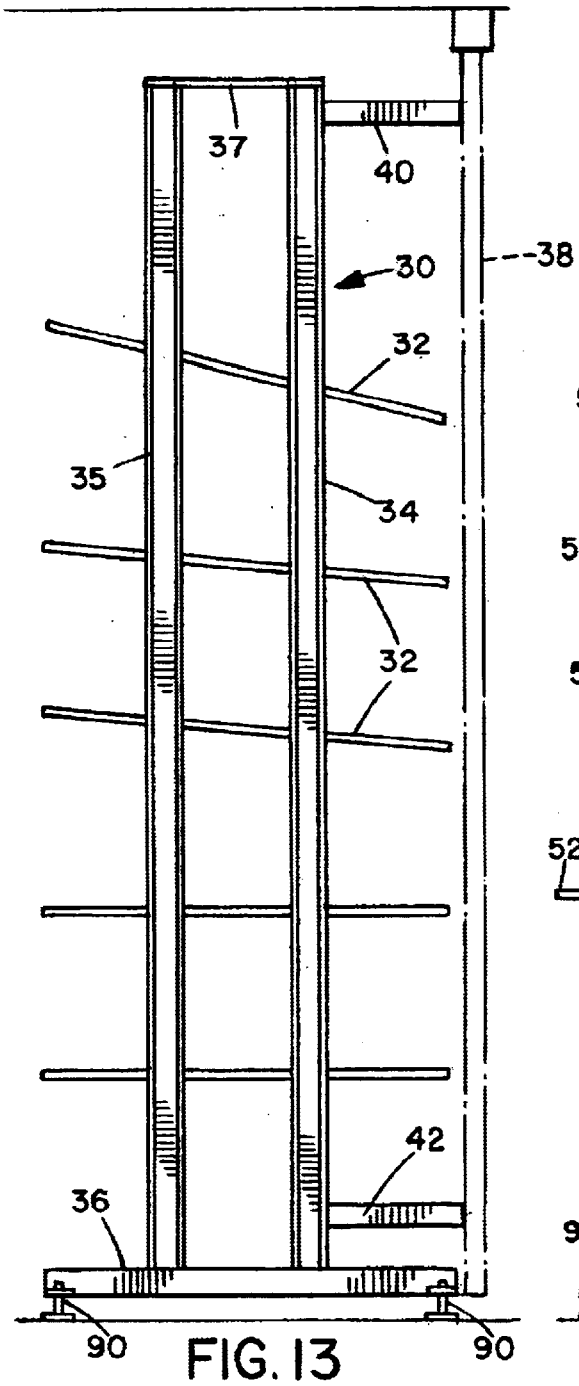
FIG. 13 is a side view of a complete shelf unit, typical cabinet enclosure structure being indicated in broken line.
Figure 13A:
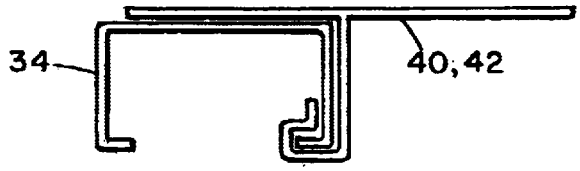
FIG. 13A is a top view illustrating a bracket for horizontal support of a post.

FIGS. 4 to 13 illustrate a shelving system according to a first exemplary embodiment of the present invention. As best illustrated in FIGS. 4 and 13, the system basically comprises an upright support framework 30 and a series of shelves 32 supported at selected intervals on framework 30. The framework 30 comprises two pairs of upright support posts 34,35, one on each side of the shelves (see FIG. 4). Each pair of posts comprises a front post 34 and a rear post 35, and the posts may be secured to a base member 36 at their lower ends, as illustrated in FIG. 13. Base members 36 may have leveling screws 90 if desired. Each front post 34 is also secured horizontally to the frame 38 of a display cabinet by an upper bracket 40 and a lower bracket 42, as best illustrated in FIGS. 13 and 13A. A cross bar 37 may extend between the upper ends of each pair of posts 34,35.

Figure 5:
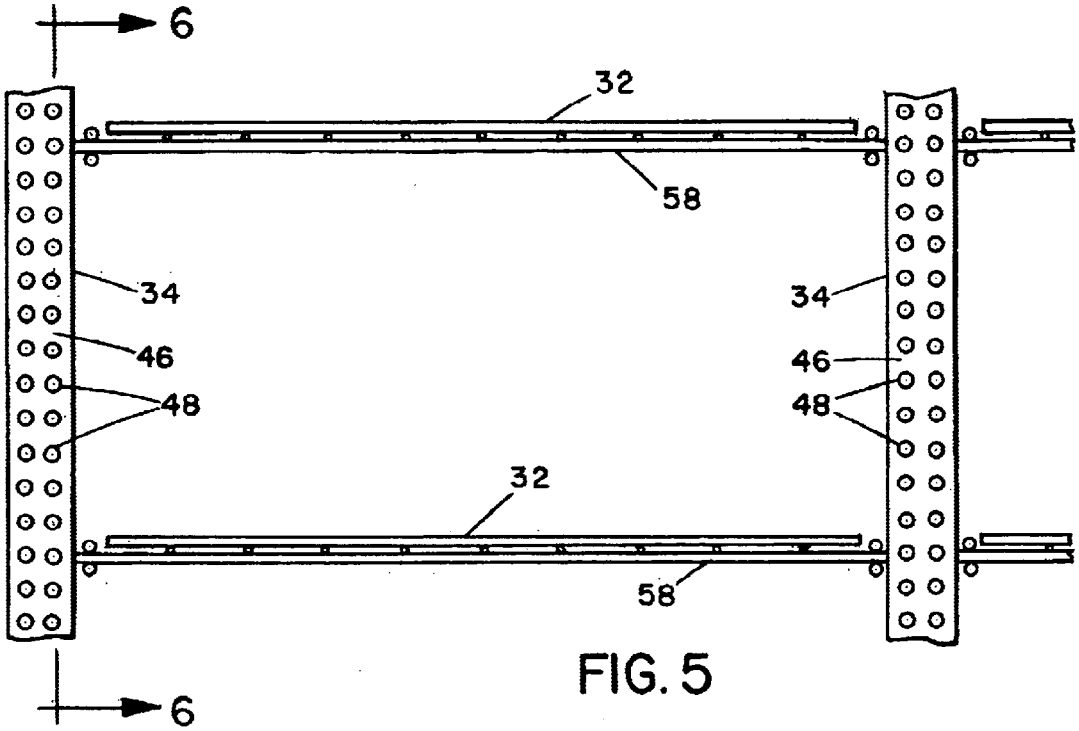
FIG. 5 is an enlarged front view of a portion of the structure of FIG. 4.
Figure 6:
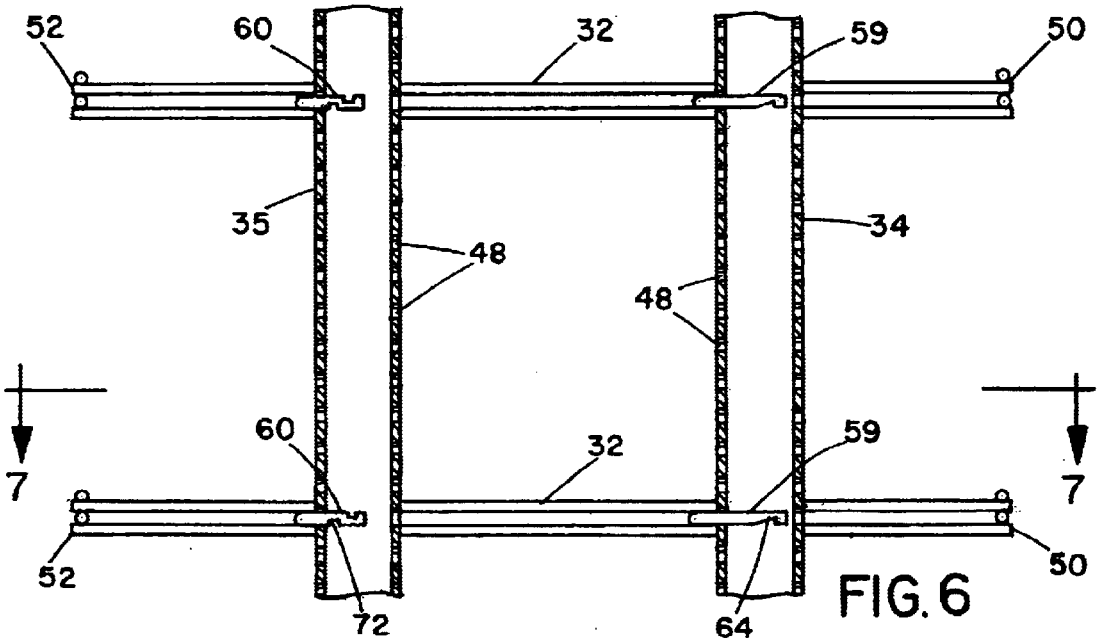
FIG. 6 is a sectional view taken on line 6—6 of FIG. 5.
Figure 7:
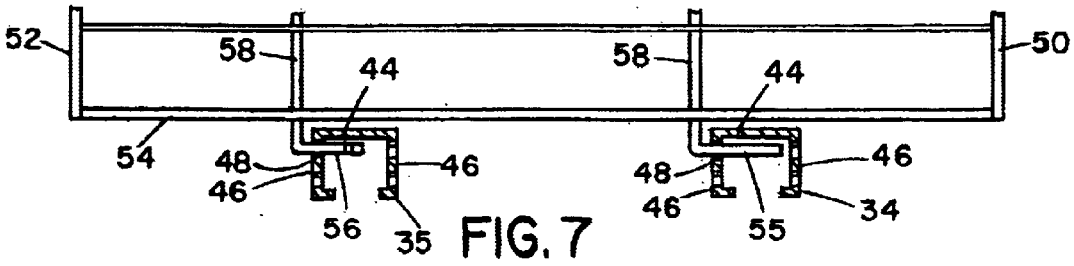
FIG. 7 is a sectional view taken on line 7—7 of FIG. 6.
Figure 10:
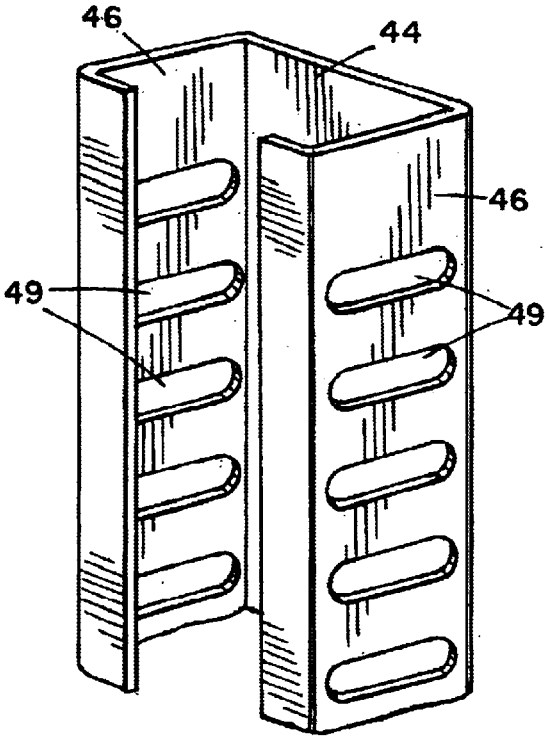
FIG. 10 is a perspective view of a portion of a post showing slots instead of individual holes.

Each post 34,35 can be of any type of open shape, such as angle, "T," or flat bar, and is shown here as generally C-shaped or rectangular channel construction, with a front wall 44 and a pair of side walls 46 projecting away from the front wall, as illustrated in FIGS. 4, 7 and 10. Usually all four posts will be the same shape, but this is not essential. At least the rearmost side wall 46 has a series of spaced openings 48 extending from the lower end to the upper end of the post. The openings may be of any configuration, and are circular holes arranged in pairs in one example, as illustrated in FIG. 5. In another embodiment, the openings are horizontal elongated slots 49, as illustrated in FIG. 10, so that each post can support shelves positioned on either side of the post. The front and rear posts are spaced apart by a distance less than the length of a shelf 32, i.e. the distance from the front edge 50 to the rear edge 52 of the shelf, and the opposite pairs of posts are designed to be positioned adjacent the opposite side edges 54 of the shelves, at a location spaced from the front and rear edges of the shelves, as indicated in FIG. 4.

Figure 8:
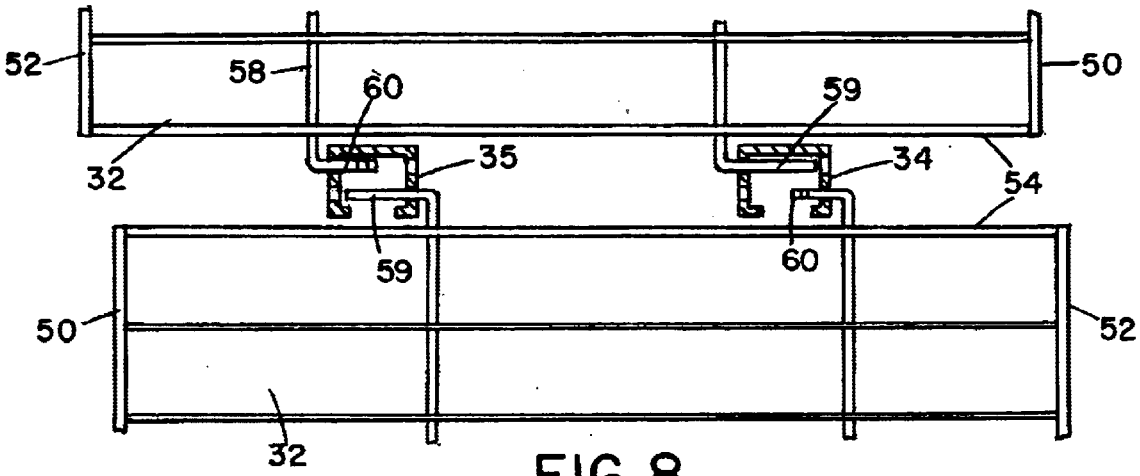
FIG. 8 is similar to FIG. 7, but showing an additional shelf mounted in a reversed position.
Figure 9:
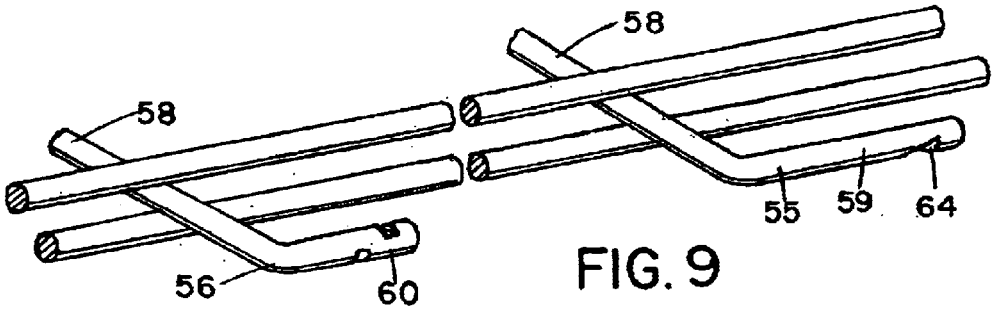
FIG. 9 is a perspective view of a portion of a shelf showing the mounting hooks.

Each shelf may be of any suitable material or construction, such as wire or plastic grille or flat plate construction. The shelf 32 has a pair of hooks projecting outwardly from each side edge 54, comprising a first hook 55 and a second hook 56 spaced rearwardly from the first hook. Preferably, each hook is formed as a continuation of one of the shelf cross bars 58, as best illustrated in FIGS. 8 and 9. Each hook is typically co-planar with the plane of the shelf 32. The first hooks 55 each have a first portion projecting transversely outwardly from the shelf, and a second portion 59 projecting forwardly from the first portion for engagement through a selected opening 48 in post 34. Similarly, the second hook 56 has a first, outwardly projecting portion and a second, forwardly projecting portion 60 for extending through a selected opening in post 35. The second portion 59 of hook 55 is longer than the second portion 60 of hook 56, so that portion 59 can first be inserted through an opening 48 in post 34, and the shelf can be pushed forwards to allow portion 60 of hook 56 to be inserted through an opening 48 in the other post 35, as best illustrated in FIG. 8. Each first or front hook 55 is spaced a substantial distance from the front edge 50 of the shelf, equal to approximately one third of the length of the shelf, as can be seen in FIG. 4. Also, the spacing between each first and second hook 55,56 is approximately equal to the spacing between the front edge of the shelf and the first hook.

Shelves can be installed horizontally, as illustrated for the lowermost two shelves in FIG. 13, or at a selected slant, as indicated for the upper three shelves in FIG. 13. In order to install a shelf horizontally, the forward hooks 55 are engaged in holes at a selected height in the front posts 34, and the rear hooks 56 are then engaged in holes at the same height in the rear posts 35. In order to install a shelf at a tilted angle, the forward hooks 55 are first engaged in holes in posts 34 at a selected height, and the rear of the shelf is then tilted upwardly to a selected tilt angle, before engaging hooks 56 in posts 35 at the desired height. As best illustrated in FIGS. 9 and 12, the hole engaging portion 59 of the hook 55 has a notch 64 in its lower surface adjacent the free end 65 of the hook. Notch 64 has a sharp front edge 66 for preventing the hook from being pulled out when adjusting the slant of the shelf. The rear edge 68 of the notch 64 is angled at a taper so that the shelf can be pushed forward after initial engagement of portion 58 in a hole 48, without having to lift the shelf to clear the notch 64.

Figure 11A:
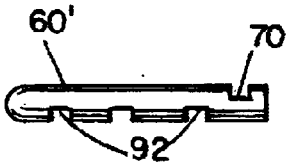
FIG. 11A is a side view of a modified rear mounting hook.

The hole engaging portion 60 of the rear hooks 56 has an upper sharp notch 70 adjacent its end 71, and a lower sharp notch 72 spaced rearwardly from notch 70, as best illustrated in FIGS. 9 and 11. The upper notch 70 prevents the hook from being accidentally pushed out of the hole 48 if the shelf is loaded only at the front. The lower notch 72 prevents the shelf from being pulled out without lifting the rear end of the shelf to clear the notch 72 and can be used to position the shelf. Additional notches 92 as shown in FIG. 11A, or other locating details can be used to position the shelves in various specific front to back positions.

The height of slot 49 or diameter of an opening 48 may be only slightly greater than the diameter of the hole engaging portions 59,60 of the hooks. This ensures that the shelf is very stable and will not "teeter-totter" if the shelves are loaded unevenly. If this is not of a concern, the slots could be replaced by hooks and/or other locating features. Since the support posts 34,35 are open channel members, they can be easily and thoroughly cleaned, so that sanitation requirements can be readily met. Also, the support posts are all inset away from the aisles outside the cabinet frame, as indicated in FIG. 13, and are protected from impact with carts and the like. This means that they do not have to be of such strong construction, and can be made thinner to provide more display space and cast less of a shadow. Also, they may be positioned away from the strip lights at the front of the cabinet, and cut off less light from the items displayed on the shelves. Also, the thinner post may greatly reduce or eliminate the "end door problem". The positioning of the support posts to the sides of each shelf means that the entire front end of the shelf is available for item display. Many configurations of this system allow two shelves to be arranged side-by-side so products can extend from one shelf to the next in front of the support posts, essentially concealing the support structure from customers and making a much more attractive display and providing additional shelf space.

FIG. 4 illustrates an arrangement where two sets of shelves are mounted side-by-side, with hooks 55 and 56 at the adjacent side edges of two shelves engaging in adjacent holes 48, or in opposite ends of a slot 49, on one side wall 46 of each of the two posts 34, 35 located between the shelves. To provide much more additional front to back positioning flexibility, the shelves may be mounted in a reversed position, as illustrated in FIG. 8. In FIG. 8, the first shelf is installed in a direction from the rear to the front, with hooks 55, 56 projecting forwardly through openings 48 in posts 34 and 35, respectively. The second shelf (the lowermost shelf as viewed in FIG. 8) is installed in a rearwards direction, with hook 55 projecting rearwardly through an opening in rearmost post 35, and hook 56 protecting rearwardly through an opening in forward post 34. This will result in the second shelf being staggered outwardly from the front edge 50 of the first shelf, as indicated.

Figure 14:
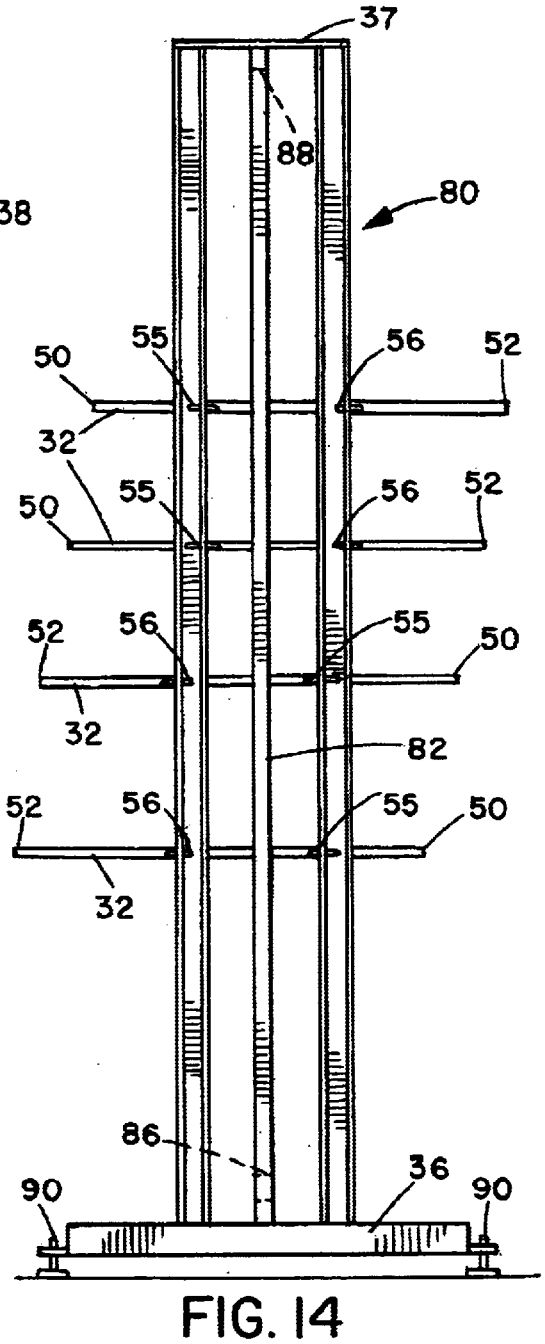
FIG. 14 is a side view of an alternative configuration of the shelf unit frame.
Figure 15:
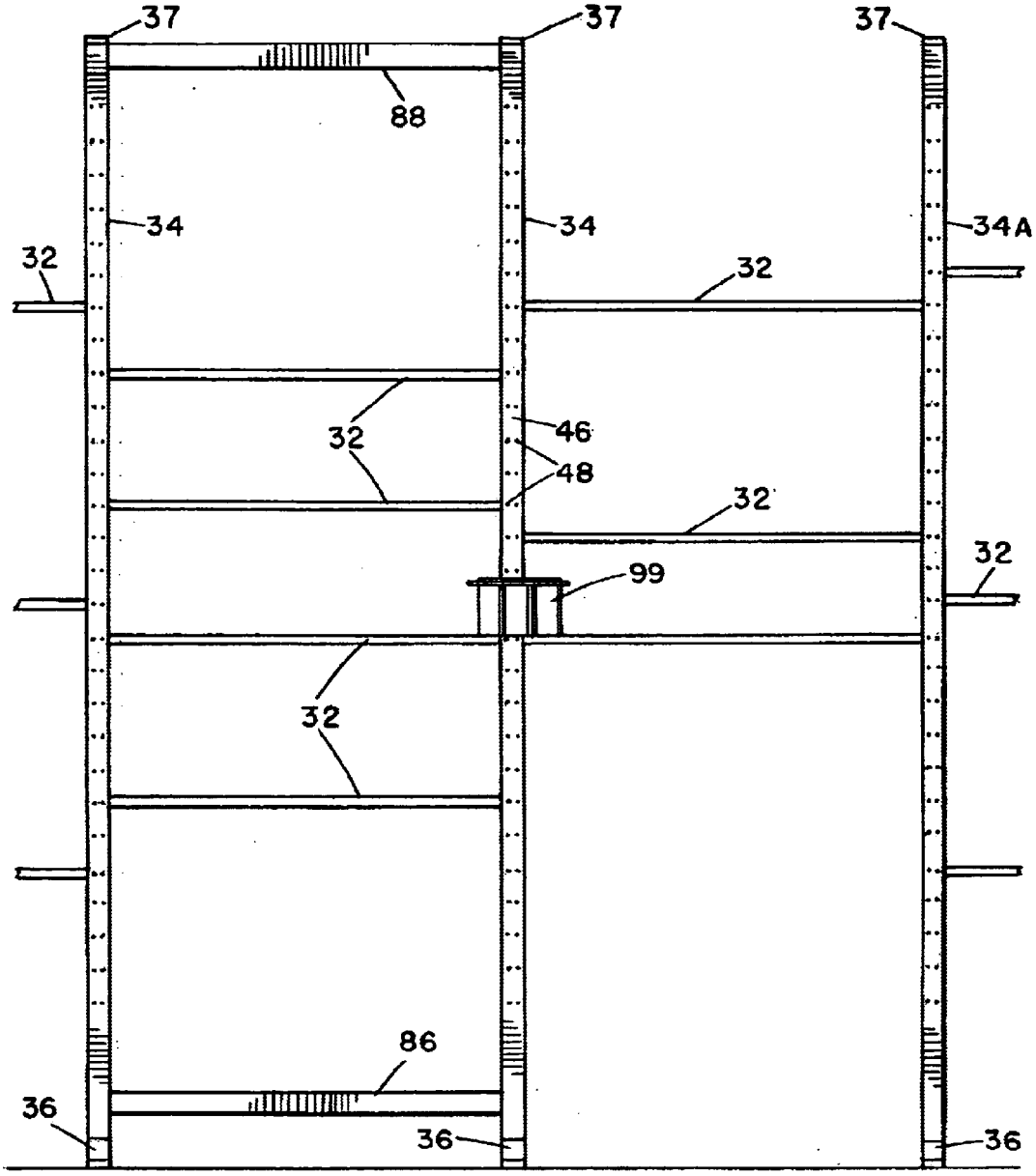
FIG. 15 is a front view of a shelf assembly as shown in FIG. 14.
Figure 16:
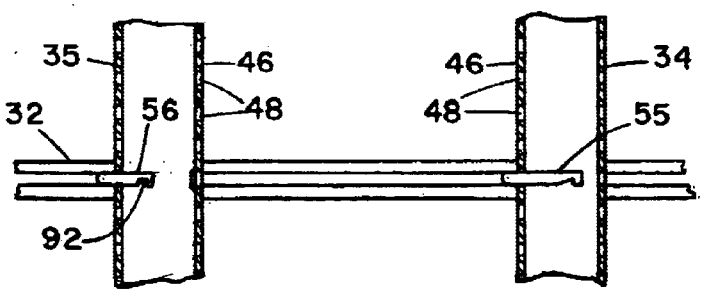
FIG. 16 is a partial sectional view similar to FIG. 6 illustrating the modified rear hook arrangement.

FIGS. 14 to 16 illustrate a shelving system according to a second exemplary embodiment of the invention. This embodiment is similar in some respects to that of FIGS. 4 to 13, and like reference numerals have been used for like parts as appropriate. However, the support frame and hook arrangement is different. As in the previous embodiment, the system basically comprises an upright support framework 80 and a series of shelves 32 supported at selected intervals on framework 80. The framework 80 comprises two pairs of upright support posts 34,35, one on each side of the shelves. Each pair of posts comprises a front post 34 and a rear post 35, and the posts may be secured to a base member 36 at their lower ends. Each base member may have leveling devices here shown as a projecting bracket 90 at each end and may be bolted to the floor with leveling screws for added stability. Unlike support framework 30, each side of the framework 80 also may have a support bar 82 or bars at each side, projecting upwardly from base member 36 between posts 34 and 35 to the top of the framework, and the cross bar 37 extends across the upper ends of the posts 34,35 and support bar 82. A lower connecting bar 86 extends between the support bars 82 beneath the level of shelves 32, and an upper connecting bar 88 extends between the support bars 82 at the top of the framework. This makes the framework much stronger, so that it can be self-supporting, avoiding the need for brackets securing the framework to the door frame of the cabinet. If the usual posts 80 are strong enough, the intermediate support bar(s) can be eliminated and the bars 86 and 88 can be connected directly to the posts.

As in the previous embodiment, each post 34,35 may be of generally U-shaped or rectangular channel construction, with a front wall 44 and a pair of side walls 46 projecting away from the front wall, and a series of spaced openings 48 in each side wall. The openings may be arranged in pairs in one example, as illustrated in FIG. 16, or a single, elongate horizontal slot may be used, as in FIG. 10, so that each post can support shelves positioned on either side of the post. As in the previous embodiment, by putting holes in both side walls of each post, a shelf can be turned around and installed in the opposite direction, from front to back rather than back to front.

As in the first embodiment, each side edge 54 has a first or forward hook 55 for engaging openings in one of the posts, and a second hook 56 spaced rearwardly from hook 55 for engaging openings in the other post. In this embodiment, the second or rearmost hook may have a series of lower notches as indicated in FIG. 11A, to provide a better locating mechanism for installation of shelves from front to back rather than back to front. The front hook 55 is identical to the front hooks of the previous embodiment, with a notch 64 in its lower surface adjacent the free end of the hook. The rear or second hook has two or more lower locating notches 92, and an upper notch 70 as best illustrated in FIG. 11A.

Assembly of the shelving system will now be described in more detail with reference to FIGS. 14 to 16. The lowermost two shelves 32 in FIG. 14 are shown installed horizontally from the back to the front of the system in staggered positions so that the front edge 50 of the lower shelf is inset inwardly from the shelf above it. The front hooks 55 are first engaged through selected holes 48 in the rearmost side wall of the front posts, and the rear hooks 56 are then engaged through aligned holes in the rearmost side wall of the rear posts, with the shelves being pushed forward to the desired positions, one with the rearmost notch 92 engaging over the edge of opening 48, and the other with a forward notch 92 engaging over the edge of the opening. The uppermost two shelves are reversed and installed from front to rear, so that the hooks 55 engage in openings in the front side wall of post 35, and the hooks 56 engage in the openings in the front side wall of post 34. The uppermost shelf is positioned such that a rear notch 92 is engaged over the edge of the respective opening 48, while the shelf below it is pushed further back so that a front notch 92 engages over the edge of the respective opening. This produces a stack of four gradually staggered shelves, which can provide a more attractive and readily visible display of products. The arrangement may be reversed, with the front or forward edges staggered progressively outwardly from the top to the bottom of the display, if desired.

The shelves in the system of FIGS. 14 to 16 can also be readily slanted, as in the previous embodiment, simply by tilting the rear end of a shelf upwardly after engaging the front hooks in a selected post opening, and then engaging the rear hooks in the appropriate openings.

FIG. 15 illustrates an arrangement in which two stacks of shelves are arranged side-by-side, with the shelves in each stack engaging adjacent holes 48 in the same posts at the center of the arrangement. The next pair of posts 34A does not have to be attached to the frame 80, since they will be held vertically by the shelves.

As in the previous embodiment, the height or diameter of an opening 48 is only slightly greater than the diameter of the hole engaging portions of the hooks. This ensures that the shelf is very stable and will not "teeter-totter" if the shelves are loaded unevenly. The adjacent pairs of holes may each be replaced by a single, horizontal slot, if desired. In both embodiments, the support posts are open channel members, and they can be easily and thoroughly cleaned. Thus, sanitation requirements for shelving in food stores can be met. Also, the support posts are all inset away from the aisles outside the cabinet frame, and are protected from impact with carts and the like. This means that they do not have to be of such strong construction, and can be made thinner to provide more display space. Unlike prior art arrangements, the support posts are positioned to the sides of the shelves, away from the strip lights at the front of the cabinet, and cut off less light from the items displayed on the shelves. The positioning of the support posts to the sides of each shelf means that the entire front end of the shelf is available for item display. When two or more stacks of shelves are arranged side-by-side in this system, products can extend from one shelf to the next in front of the support posts, essentially concealing the support structure from customers and making a much more attractive display with more product. The system is also very versatile, and permits shelves to be installed in horizontal or slanted orientations. The arrangement also permits shelves to be arranged in a staggered manner.

The difference between the shelving system of FIGS. 4 and 13 and that of FIGS. 14 to 16 is how the support posts are held vertically. In FIGS. 4 to 13, the support posts are held vertically by attaching them to a base that extends to the front and back edges of the shelves, and attaching the posts to the frame. In FIGS. 14 to 16, the support posts are held vertically without attaching them to the frame, by attaching two sets of posts together at the proper spacing for the shelves, forming a "box" like configuration. Additionally shelves and posts may be added to the right or left of the box, with the shelves keeping the outer post in an upright configuration.

Figure 17:
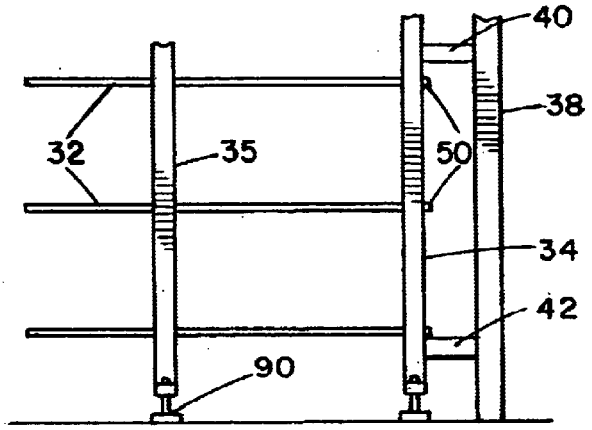
FIG. 17 is a view similar to a portion of FIG. 13, showing a free standing adjustable rear post.

A third post arrangement is illustrated schematically in FIG. 17. This arrangement does not require a base. The front posts 34 are attached rigidly to the cabinet frame wall or other permanent structure. The rear posts 35 are free standing and held vertical by the shelves 32. Since the front posts are rigidly attached to the frame 38 by brackets 40, 42, they cannot be lifted by uneven loading of the shelves or someone stepping on the back of the shelf. The front posts are positioned close to the front 50 of the shelves in this arrangement, so that pressure on the front of the shelves will not lift the rear posts.

Shelving systems require various accessories, such as a side product stop to keep the product from falling off the side of the shelf. Gravity feed shelves which are inclined downwardly to feed product automatically to the front of the shelf require a gravity feed rack with dividers for separating the products into columns each containing a line of single products such as cans. In a typical prior art supermarket shelving system with cut-outs at the corners of each shelf, as illustrated in FIG. 1, the side product stops are secured to the posts. One problem with this is that the product stop does not move with the shelf, so that if the shelf is moved to a new location, the product stop must also be moved. Typical gravity feed racks are secured to shelves by welding or other methods.

Figure 18:
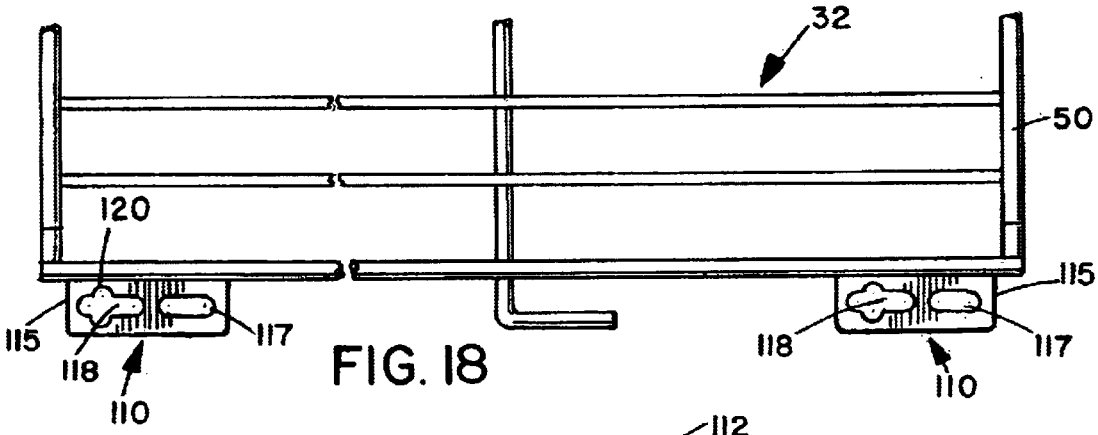
FIG. 18 is a top view of one side of a shelf, showing support brackets for side stops or other accessories.
Figure 19:
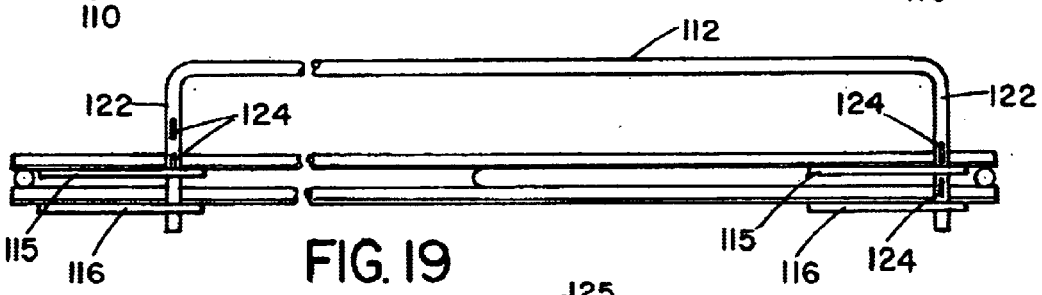
FIG. 19 is a side view of the structure of FIG. 18 with a side stop in place.
Figure 20:
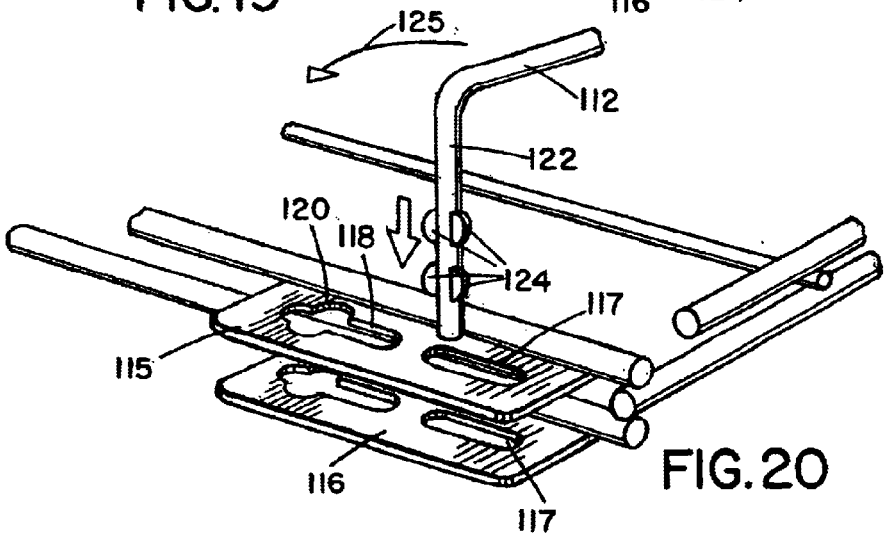
FIG. 20 is a perspective view of one support bracket assembly showing the insertion of a side stop.

FIGS. 18 to 20 illustrate modified shelves 32 having front and rear side bracket assemblies 110 projecting outwardly from each side of the shelf for selective mounting of a side product stop 112 and a gravity feed rack 114 or other accessories. Each side bracket assembly comprises flat, parallel upper and lower brackets 115,116 each having a pair of mounting slots 117,118 aligned with the slots in the other bracket. For a number of applications, one bracket in front and one in the rear is satisfactory. The front slot 117 is an oval or elongate shape, and the rear slot 118 is an elongate shape with side ears 120 adjacent one end to provide a wider opening than the remainder of the slot. The front bracket assembly in this example is secured adjacent the front edge 50 of the shelf, while the rear bracket assembly is positioned between the rear edge of the shelf and the rear hook 60. However, other locations may be selected as appropriate.

As best illustrated in FIG. 19, the side product stop 112 comprises a rod with downwardly projecting, parallel end portions 122 projecting downwardly at a right angle to the remainder of the rod. Each end portion has two pairs of diametrically opposing ears or projections 124. The side product stop 112 is installed by first inserting one end portion 122 into the front mounting slot 117 of the front bracket assembly in the orientation illustrated in FIG. 20, where the stop 112 extends parallel to the front edge 50 of the shelf so that the lowermost ears 124 can pass through the slot 117 in the uppermost bracket 115. The stop 112 is then pivoted in the direction of arrow 125 until it is parallel to the side of the shelf, locking the front end portion 122 into the bracket assembly due to the location of lower ears 124 between brackets 115,116 with the upper ears seating on the top bracket 115 (see FIG. 19). The rear end portion 122 then is set in the slot of the rear bracket. Th side product stop is thus locked in the front of the shelf (the customer side). This arrangement allows side product stops to be installed on each side of a shelf both quickly and easily, and the side product stops are then secured to, and movable with, the shelf. In an alternative arrangement, each leg portion 122 may have a single pair of opposing ears. In this case, the ears on the front leg portion will be positioned between the plates. In another alternative, each leg portion has two pairs of ears as in FIGS. 18 to 20, but each bracket assembly has only one bracket, with one set of ears below the bracket and one set above the bracket.

Figure 21:
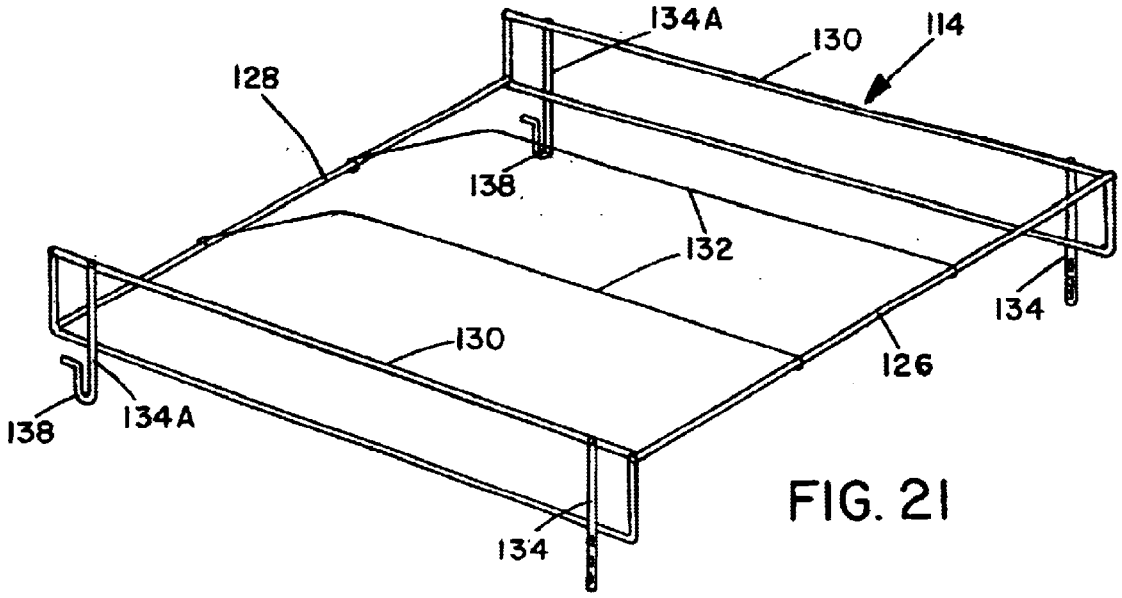
FIG. 21 is a perspective view of a gravity feed rack.
Figure 22:
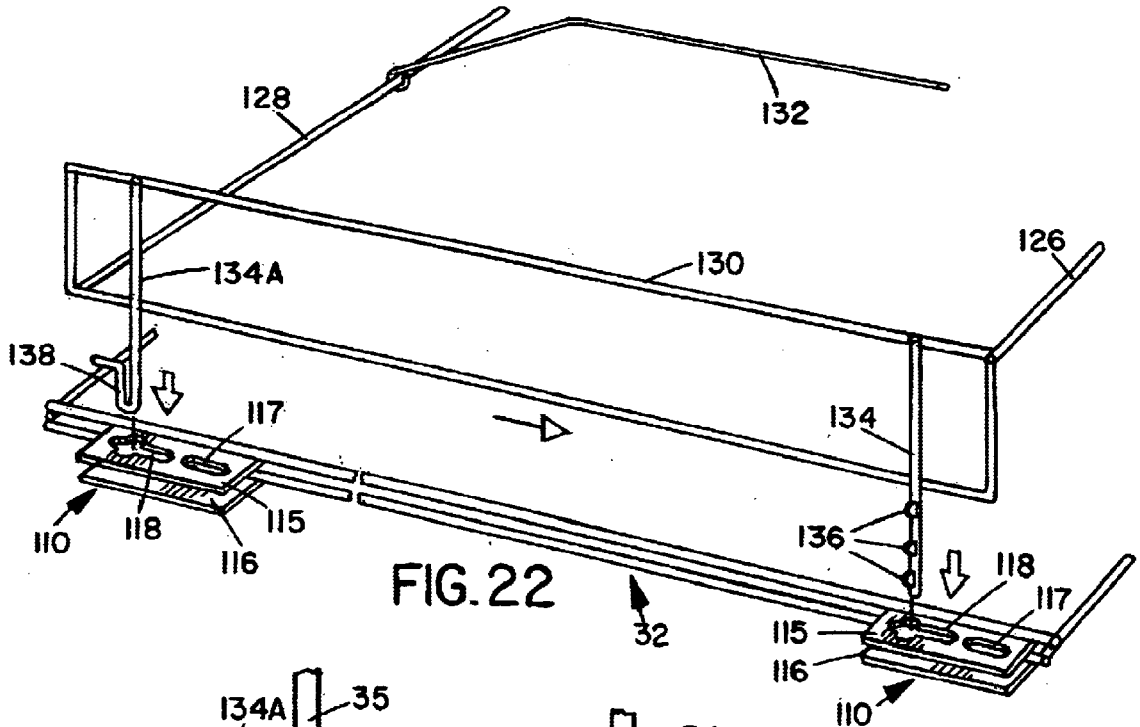
FIG. 22 shows the attachment of the gravity fee rack to the support brackets.
Figure 23:
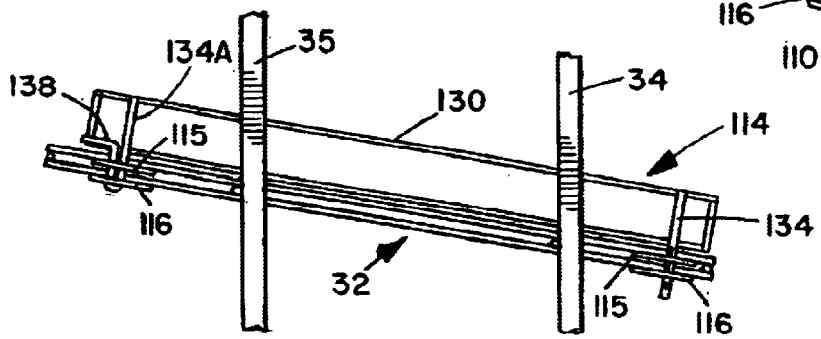
FIG. 23 is a side view of an inclined shelf using the gravity feed rack.

FIG. 21 illustrates a gravity feed rack 114, while FIGS. 22 and 23 illustrate installation of a gravity feed rack 114 using the bracket assemblies 110. The feed rack 114 is of similar dimensions to a shelf 32 and has a front end 126, a rear end 128, and opposite sides 130. Dividers 132 may extend from the front end to the rear end of the rack in a direction parallel to the sides 130. The dividers or partitions 132 may be adjustable or fixed to partition the shelf into separate, parallel lanes for lining up cans, bottles and the like, and the lanes can be gravity fed by slanting the shelf. For some applications, no dividers are needed so the back 128 may be eliminated. The feed rack 114 is modified according to one embodiment of the present invention to provide a first downwardly projecting leg 134 projecting downwardly at each side of the rack adjacent the front end 126 of the rack, and a second downwardly projecting leg 134A spaced rearwardly from leg 134 on each side of the rack at a spacing equivalent to the spacing between the front and rear bracket assemblies 110 of a shelf. Each leg 134 has a plurality of pairs of diametrically opposed, outwardly projecting ears or projections 136, similar to the ears 124 on the end portions of the side stop 112 described above. Each leg 134A has a hook-shaped lower end portion 138. Although this type of assembly is usually used in a slanted position to feed product, some applications require the shelf to be kept in a flat position.

The gravity rack is installed by inserting the legs 134 on each side into the bracket slots 118 in alignment with the widest portion of each slot at the location of side ears 120, providing clearance for the ears or projections 136. The rack is then pushed forward, so that the legs 134 are located in the narrower, forward end of each slot 118, and at least one set of ears 136 is located beneath bracket 115 so as to lock the rack in position as indicated in FIG. 23. In this way, any shelf can easily and economically be converted into a gravity feed shelf for cans, bottles, or the like.

By having a plurality of "ears", the front of the gravity feed rack can be adjusted up or down. Other accessories and different types of gravity feed racks, such as those having just a front without sides or back, can be installed in a similar manner. Although the front legs 134 have plural sets of ears for height adjustment in the illustrated embodiment, a single ear may be provided where height adjustment is not needed. Also, the brackets may each have only one slot in other alternative configurations, and a single plate or bracket may be provided in place of the pairs of brackets 115,116.

In each of the embodiments illustrated in FIGS. 18 to 23, the projections or ears may be replaced with indentations for fitting over the edges of the respective slot to lock the accessory in position, or any other suitable formation, on one or both sides of the respective leg. The side stop legs or end portions 122 of FIGS. 8 to 20 may also be modified to have engagement or locking formations the same as those provided on legs 134, 134A of the gravity feed rack of FIGS. 21 to 23. Thus, the front end portion 122 will have a series of spaced ears 136 while the rear end portion 122 will have a hook formation 138. This allows the side stop to be installed straight down into the bracket slots 118, so that the shelf does not have to be rotated. This allows a loaded shelf to be installed with a side product stop. If the slot 118 is close to the side of the shelf, the shelf side will keep the stop in a vertical position, avoiding the need for a second bracket plate 116. Also, in this arrangement, the front slots 117 may be eliminated.

The elimination of the corner cut outs on the shelves, and the new shelving support system of this invention, therefore allows mounting brackets to be readily provided at the side edges of each shelf for easy and inexpensive mounting of side stops, gravity feed racks, or other accessories.

Although some exemplary embodiments of the invention have been described above by way of example only, it will be understood by those skilled in the field that modifications may be made to the disclosed embodiments without departing from the scope of the invention, which is defined by the appended claims.

I claim:

1. A shelving system, comprising:

a plurality of shelves each having a front edge, a rear edge, and opposite sides, the shelf having a predetermined length between the front edge and the rear edge;

each side of the shelf having a front hook and a rear hook projecting from the side, the rear hook being spaced forwardly from the rear edge of the shelf and rearwardly from the front hook;

each front hook being spaced rearwardly from the front edge of the shelf by a distance equal to approximately one third of the shelf length; and a support framework for adjustably supporting a series of shelves at spaced intervals, the framework comprising a pair of vertical support posts located on each side of the shelves, each pair of support posts comprising a front support post located adjacent the respective front hook of each shelf and a rear support post located adjacent the respective rear hook of each shelf, and each support post having a series of spaced openings for receiving the shelf hooks.

2. The system as claimed in claim 1, wherein each hook is bent towards the front of the shelf.

3. The system as claimed in claim 1, wherein each hook has an undersurface with at least one indentation for preventing the hook from being pulled out of an opening accidentally.

4. The system as claimed in claim 3, each front hook has a free end for insertion through a selected post opening and a notch in its undersurface adjacent the free end, the notch having a sharp forward edge and an inclined, tapered rear edge.

5. The system as claimed in claim 3, wherein each rear hook has an upper surface, a free end, and an upper notch adjacent the free end of the hook.

6. The system as claimed in claim 3, wherein each rear hook has a plurality of spaced engagement formations in its undersurface for selective engagement over a hole edge.

7. The system as claimed in claim 1, wherein each hook is formed from a rod of predetermined diameter, and each opening is of predetermined height slightly greater than said rod diameter.

8. The system as claimed in claim 1, wherein each post has a front side wall and a rear side wall, and openings are provided in at least one of said side walls.

9. The system as claimed in claim 8, wherein openings are provided in both side walls of each post, whereby shelves may be installed in a direction from the rear to the front or in a reverse direction from the front to the rear.

10. The system as claimed in claim 8, wherein the openings comprise a series of vertically spaced, aligned pairs of circular holes.

11. The system as claimed in claim 8, wherein the openings comprise vertically spaced, horizontal slots.

12. The system as claimed in claim 1, wherein the framework comprises a pair of side frames, each side frame comprising a base member and said pair of posts projecting upwardly from the base member.

13. The system as claimed in claim 12, wherein the side frames are secured together.

14. The system as claimed in claim 1, wherein each post is of rectangular channel shape, having a front wall positioned parallel to a shelf side, spaced side walls, and an open rear face.

15. The system as claimed in claim 1, wherein each shelf is rectangular with no cut-outs at the corners of the shelf.

16. The system as claimed in claim 1, wherein the front and rear hook on each side of the shelf are at a predetermined spacing, the spacing being substantially equal to the distance between the front hook and front edge of the shelf.

17. A shelving system, comprising:

a plurality of shelves each having a front edge, a rear edge, opposite sides, and front and rear corners at junctions between each side and the respective front and rear edges;

each side of the shelf having a front hook and a rear hook projecting from the side, the front hook being spaced rearwardly a predetermined first spacing from the front edge of the shelf and the rear hook being spaced rearwardly from the front hook by a predetermined second spacing and spaced forwardly a predetermined distance from the rear edge of the shelf, the first and second spacings being approximately equal; and a support framework adjustably supporting a series of shelves at spaced intervals, the framework comprising a pair of vertical support posts located on each side of the shelves, each pair of support posts comprising a front support post located adjacent the respective front hook of each shelf and a rear support post located adjacent the respective rear hook of each shelf, and each support post having a series of spaced openings, the shelf hooks being engaged in selected openings in the respective support posts based on a predetermined shelf spacing;

whereby a forward portion of each shelf equal in length to said first spacing projects forwardly from the front support post and a rearward portion of each shelf projects rearwardly from the rear support post.

* * * * *